US008562259B2

(12) United States Patent
Ridgway et al.

(10) Patent No.: US 8,562,259 B2
(45) Date of Patent: Oct. 22, 2013

(54) COMBINED STRUT AND CONNECTOR RETAINING WALL SYSTEM AND METHOD THEREFOR

(75) Inventors: Jon Robert Ridgway, Marietta, GA (US); Willie Liew, Smyrna, GA (US); Robert Lloyd Talbot, Neosho, MO (US); Jeremy Lee Stafford, Neosho, MO (US)

(73) Assignee: Tensar International Corporation, Alpharetta, GA (US)

( * ) Notice: Subject to any disclaimer, the term of this patent is extended or adjusted under 35 U.S.C. 154(b) by 329 days.

(21) Appl. No.: 12/923,934

(22) Filed: Oct. 14, 2010

(65) Prior Publication Data

US 2011/0091290 A1 Apr. 21, 2011

Related U.S. Application Data

(60) Provisional application No. 61/272,669, filed on Oct. 19, 2009.

(51) Int. Cl.
*E02D 17/20* (2006.01)

(52) U.S. Cl.
USPC ..... 405/284; 405/262; 405/302.7

(58) Field of Classification Search
USPC ..... 405/262, 284, 302.4, 302.6, 302.7, 286; 52/712; 403/206–216; 256/32, 45, 46, 256/57
See application file for complete search history.

(56) References Cited

U.S. PATENT DOCUMENTS

| | | | | |
|---|---|---|---|---|
| 4,374,798 | A | 2/1983 | Mercer | |
| 4,856,939 | A | 8/1989 | Hilfiker | |
| 4,993,879 | A * | 2/1991 | Hilfiker | 405/262 |
| 5,622,455 | A * | 4/1997 | Anderson et al. | 405/262 |
| 5,975,810 | A * | 11/1999 | Taylor et al. | 405/262 |
| 6,186,703 | B1 * | 2/2001 | Shaw | 405/262 |
| 6,595,726 | B1 | 7/2003 | Egan et al. | |
| 6,764,252 | B2 * | 7/2004 | Banting | 405/262 |
| 7,399,144 | B2 * | 7/2008 | Kallen | 405/284 |
| 2011/0311318 | A1 * | 12/2011 | Taylor | 405/284 |

* cited by examiner

*Primary Examiner* — Sean Andrish
(74) *Attorney, Agent, or Firm* — Jacobson Holman PLLC

(57) ABSTRACT

A retaining wall system formed from a wire facing unit having an upstanding face section and a rearwardly extending floor section the rear end of which is provided with aligned, transversely extending, openings defined by upstanding U-shaped protuberances. The apertures in the forward portion of a geogrid can be seated over the protuberances and a connector strut interconnects the face section and floor section for providing support therebetween and for securing the geogrid to the floor section. The connector strut includes an elongated rigid rod having a curved first end that extends to a substantially right-angled bend, and a connector rod portion extends from the bend to a second end to secure the geogrid to the floor section.

18 Claims, 9 Drawing Sheets

COMBINED STRUT AND CONNECTOR RETAINING WALL SYSTEM AND METHOD THEREFOR

This application is entitled to and hereby claims the priority of U.S. provisional application Ser. No. 61/272,669 filed Oct. 19, 2009.

BACKGROUND OF THE INVENTION

1. Field of the Invention

The present invention relates to wire facing units for reinforced earthen retaining walls wherein the face of the retaining wall is formed by a vertically extending section of the wire facing unit and which includes an integral horizontally extending floor that extends rearwardly for securing a polymer geogrid thereto. More particularly, the present invention relates to a combined, unitary connector strut which interconnects and supports the face and floor of the wire facing unit, while at the same time securing a geogrid to the floor, as well as the assembly of retaining walls with the wire facing unit and connector strut, and methods of constructing a retaining wall with such elements.

2. Description of the Related Art

The use of welded wire facing units in the construction of retaining walls is well known as is the use of polymer geogrids to reinforce such earthen formations. See, for example, U.S. Pat. Nos. 4,856,939 and 6,595,726, each of which discloses the construction of a geogrid-reinforced earthen retaining wall incorporating welded wire facing units. Polymer geogrids, particularly uniaxially stretched integral polymer geogrids of the type preferred for use in the construction of such retaining walls, may be made by the process disclosed in U.S. Pat. No. 4,374,798.

The above-referenced '726 patent discloses a wire facing unit having a face section and a floor section, with the floor section including protuberances defining aligned openings adjacent a rear edge of the floor section. The protuberances provide an effective arrangement for receiving the polymer geogrid by the placement of selected geogrid apertures over the protuberances and then inserting a relatively lengthy connecting rod through the aligned openings of the protuberances to retain the geogrid to the floor section. The connecting rod overlies the geogrid and is captured by the protuberances to retain the geogrid from disengagement with the wire facing unit under high stress conditions. In addition, a separate strut element is provided to interconnect the top of the face section with the rearward portion of the floor section, essentially defining a hypotenuse of a triangle, to support the face section with respect to the floor section and to provide strength to the overall wire facing unit. Thus, two separate and distinct elements were required to support the facing unit, as well as to connect or secure the geogrid to the floor of the facing unit.

The retaining wall system of the '726 patent has been commercialized. Although cost effective and successful, multiple steps are required to install the system. One of the first steps is to connect the geogrid to the wire facing unit through the insertion of the connector rod. A separate distinct step requires installation of the separate support struts. In the commercial system, support struts are typically required to be spaced apart no more than 16 inches to maintain proper face alignment in accordance with design guidelines of the American Association of State Highway and Transportation Officials ("AASHTO"). Specifically, such guidelines require that the face structure bulge not exceed two inches.

In addition to requiring separate and distinct connecting rods and strengthening struts, each of which perform different functions, the insertion of the elongated connecting rods is difficult to achieve where the connecting rod has to extend through several aligned openings, particularly where separate and distinct wire facing units lie in a horizontal side-by-side relationship. The connecting rod has to be lengthy, approximately the width of the facing unit because insertion is from an end region and needs to extend to or near the opposite end region. Further, for facing units intermediate the two end units, it is often required that the facing units be tilted for insertion of the connecting rod and frequently requires the connecting rod to be relatively flexible for ease of insertion. This is time consuming and labor intensive.

SUMMARY OF THE INVENTION

An initial object of the present invention is to provide a retaining wall system comprising, in combination, an assembly of elements, including a wire facing unit and a geogrid, with a unique interconnection between these elements which overcomes the foregoing and other disadvantages of prior art systems.

A further object of this invention is to provide a combined connector strut formed from a unitary or one-piece rigid rod. Specifically, it is an object of the present invention to provide a connector strut that includes an elongated support strut portion that strengthens and supports the wire facing unit and an orthogonally directed connector rod, or link, portion having a length substantially less than the width of the wire facing unit to connect and secure the geogrid to the floor of the wire facing unit quickly and easily.

Yet another object of this invention is the utilization of the connector strut with a known wire facing unit wherein the wire elements forming the rear end portions of the floor section are bent into generally inverted U-shaped protuberances which define aligned openings extending generally transversely of the floor section of the wire facing unit. The wire elements forming the protuberances are preferably spaced apart by a distance equal to, or a multiple of, the spacing between the apertures defined in the forward end portion of the geogrid so that the geogrid can be laid over the rear end of the floor section of the wire facing unit with the upstanding floor section protuberances extending through the geogrid apertures. (In the event the spacing between the geogrid apertures does not align with the spacing of the protuberances, the transverse bar of the geogrid can be cut or slit to enable the geogrid to fit over the protuberances.) The connector rod portion of the unitary connector strut can then be inserted through the aligned openings formed by the protuberances to secure the geogrid directly to the rear end of the floor section of the wire facing unit and the elongated strut portion of the unitary connector strut can then be secured to a top edge of the face section.

A still further object of this invention is to provide an assembly of elements, and a method of using the elements to easily and inexpensively form a reinforced retaining wall section, requiring the use of no extraneous materials or tools, and providing a secure engagement between the wire facing unit forming the face section of the wall and the geogrid reinforcing the fill material behind the wall.

Other and further objects of this invention will be readily understood by those with ordinary skill in the art with particular reference to the following detailed description of the preferred embodiments in combination with the accompanying drawings.

BRIEF DESCRIPTION OF THE DRAWINGS

Like reference characters refer to like parts throughout the several views of the drawings.

DETAILED DESCRIPTION OF THE PREFERRED EMBODIMENTS

Figure 1:
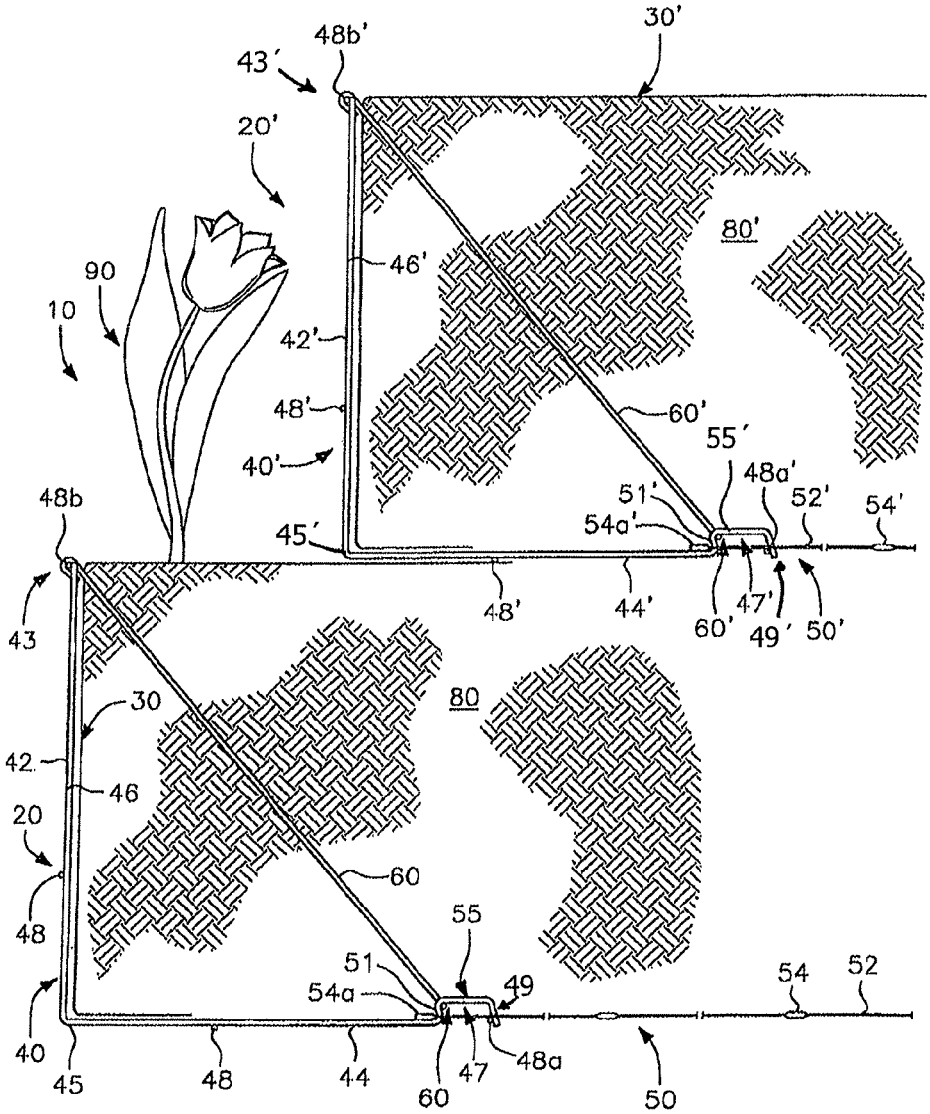
FIG. 1 is a schematic side elevational view of a portion of a geogrid reinforced retaining wall having superimposed wire facing units with the front face of the superior facing unit offset rearwardly from the front face of the facing unit therebelow to provide access to the fill for plantings.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2A:
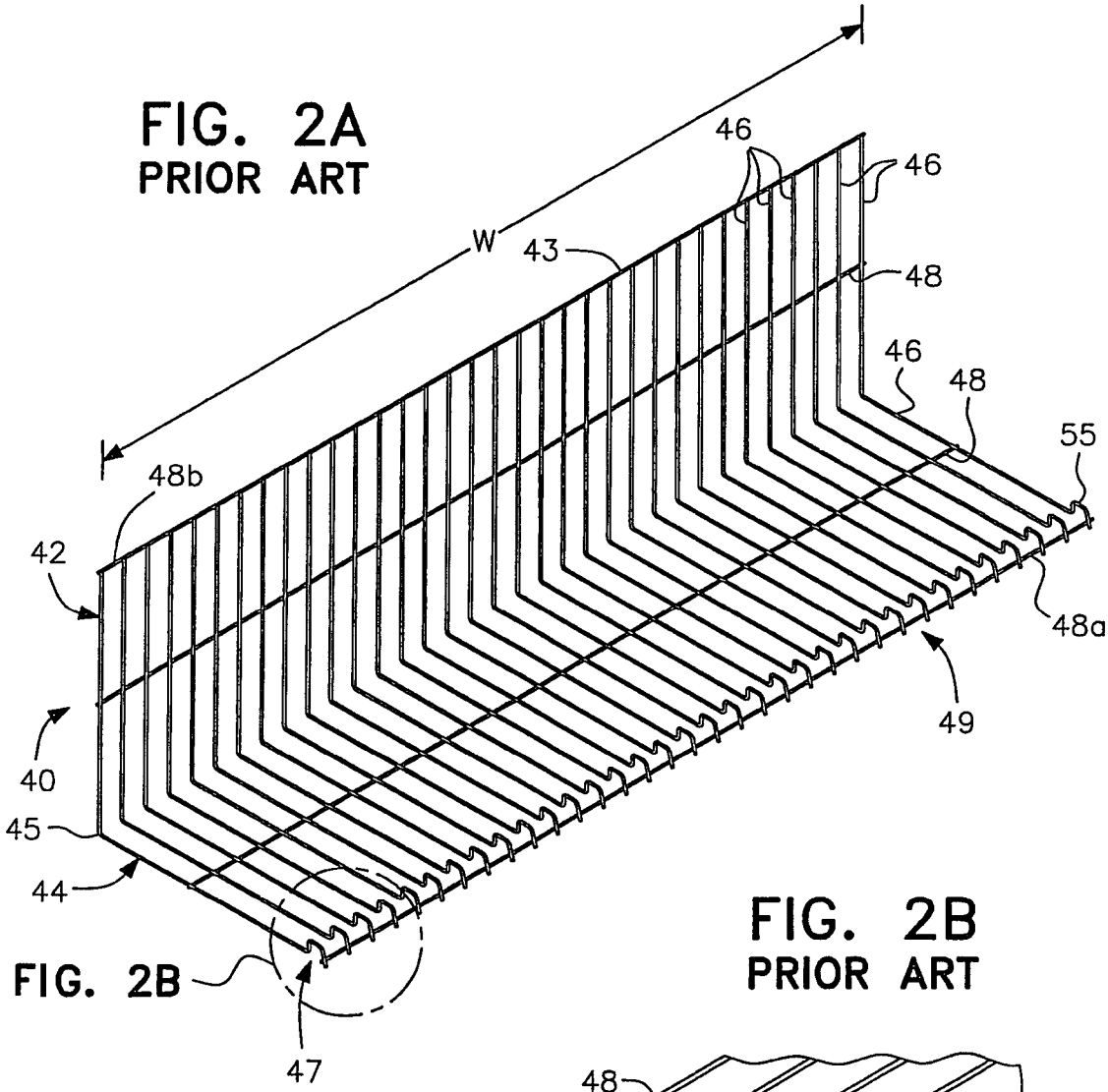
FIG. 2A PRIOR ART
FIGS. 2A and 2B depict the prior art wire facing unit utilized in accordance with the present invention.
Figure 4A:
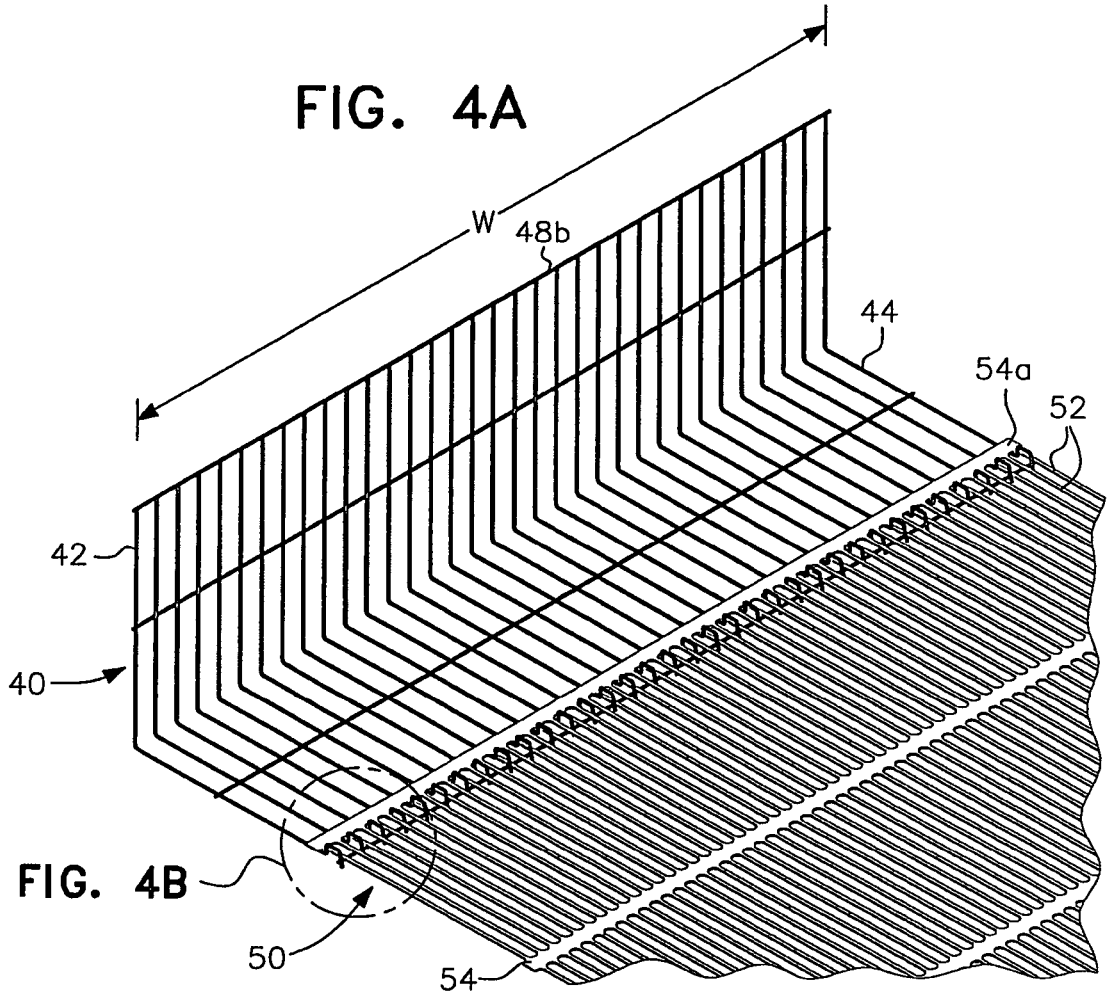
FIGS. 4A and 4B depict the end of a geogrid overlying a portion of the wire facing unit of FIGS. 2A and 2B with apertures in the geogrid overlying the protuberances in the floor section.
Figure 7:
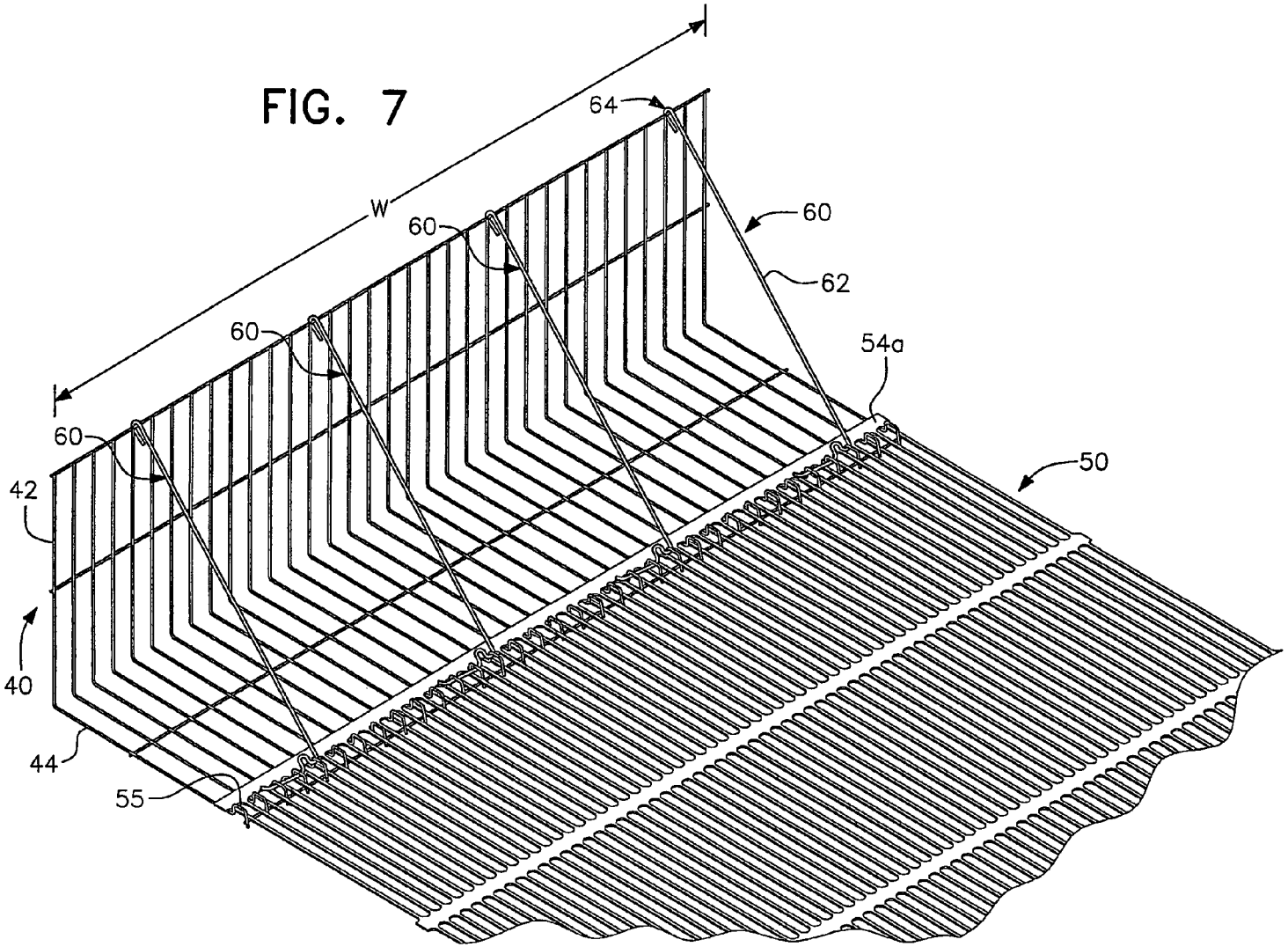
FIG. 7 depicts a completed connector strut and facing unit arrangement with the geogrid attached thereto in accordance with the present invention.

A retaining wall constructed using the system of the instant invention is designated generally by the reference numeral 10 in FIG. 1, and is shown in this Figure as including two tiers or layers 20, 20' of geogrid-reinforced wall sections, each of which has been constructed of the elements and according to the method of the instant invention. Of course, although two tiers 20, 20' are illustrated in FIG. 1, a retaining wall can be built of only a single tier, or many more than two tiers, depending on the height of the wall and the dimensions of the elements forming the wall. Not only can the height be variable, but the width of the wall can likewise be variable by providing wire facing units of different widths (width w of a facing unit is shown in FIGS. 2A and 4A) and geogrid sections of different dimensions or by associating a multiplicity of laterally juxtaposed assemblies of geogrid-reinforced wire facing units as is shown in FIG. 7 of U.S. Pat. No. 6,595,726, hereby incorporated by reference herein.

Each of the layers 20, 20' of the retaining wall 10 are formed from an assembly of elements including a wire facing unit 40, 40' one or more sections of geogrid 50, 50', a connecting strut 60, 60', and a body of fill material 80, 80', such as aggregate, including soil, or the like.

Figure 2B:
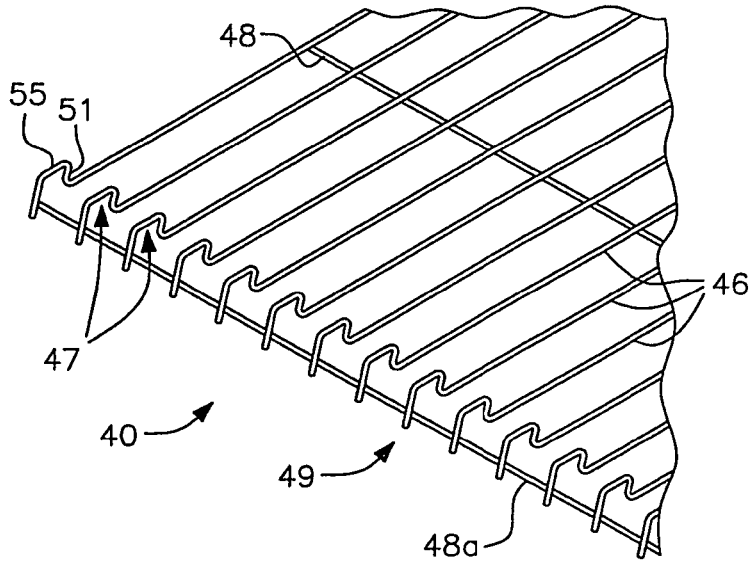
FIG. 2B PRIOR ART

The wire facing unit 40, 40' commonly formed of metal with a face section 42, 42', and a floor section 44, 44', formed by continuous, longitudinally extending wire elements 46, 46', bent generally at an angle, preferably a right angle and interconnected by a plurality of spaced, transversely extending, welded cross-wires 48, 48'. Specifically, the face section 42, 42' includes a plurality of parallel wire elements 46, 46' extending from a free top edge 43, 43' to a bottom edge 45, 45' wherein the parallel wire elements 46, 46' are interconnected by at least one transverse cross-wire element 48*b*, 48*b'* at the top edge 43, 43'. The floor section 44, 44' extends angularly from the face section 42, 42' from the face section bottom edge 45,45'. The floor section 44, 44' has a free rear edge 49, 49' and is similarly formed from plural parallel wire elements 46, 46' extending from the bottom edge 45, 45', to the rear edge 49, 49'. The parallel wire elements 46, 46' of the floor section 44, 44' are interconnected by at least one transverse cross-wire element 48*a*, 48*a'* the rear edge 49, 49'. Protuberances 55, 55' are formed adjacent the rear edge 49, 49' and define aligned openings 47, 47'. The wire facing unit 40, 40' is depicted in FIGS. 2A and 2B.

The geogrid section 50 can have any width and any length, and can be formed using any well-known prior art technology, including weaving, knitting, or other techniques for securing strands or straps to each other to form a grid-like construction. Preferably, however, the geogrid sections are formed as integral, uniaxially-stretched, polymer geogrids in accordance with the teachings of the '798 patent referenced above. Regardless of the method of forming the geogrid, it will include a plurality of spaced, generally parallel, strand elements such as shown at 52, 52', interconnected by generally transversely extending cross-bars 54, 54' or other strands which together define a multiplicity of through-apertures 56. Moreover, according to a preferred embodiment of this invention, the width of a geogrid section 50 is equal to, or an even fraction of, the width of a wire facing unit 40 so as to facilitate construction of a retaining wall according to this invention. However, geogrid sections smaller or larger than the width of a facing unit or a non-even fraction of the width of a facing unit can be used without departing from the instant inventive concepts.

At the rear end portions of the floor section 44 of the wire facing unit 40 of this invention, the longitudinally extending wire elements 46 are bent to form upstanding, generally U-shaped, protuberances 55 extending from the upper face of the floor section 44 to define generally aligned openings 47 extending generally transversely of the floor section 44 of the wire facing unit 40. The portions of the wire elements 46 forming the protuberances may be tilted forwardly to form an inclined shoulder or pocket 51 to more securely engage a geogrid section 50 as described below.

In constructing a geogrid-reinforced retaining wall section according to this invention, a wire facing unit 40 is positioned as seen, for example, in FIG. 1, with the front of the face section 42 forming a portion of the face of the retaining wall 10, and the floor section 44 extending rearwardly therefrom. The apertures 56 in the forward end portions of one or more geogrid sections 50 are then positioned over the protuberances 55 at the rear end portions of the floor section 44 of the wire facing unit 40, with at least one of the cross-bars 54*a*, 54*a* a geogrid section 50 forwardly of the protuberances 55 and seated in the pocket 51, 51' at least one of the generally transversely extending cross-wires 48*a* of the floor section 44 of the wire facing unit 40 underlying the forward end portions of the geogrid section 50, and the remainder of the geogrid section 50 extending rearwardly from the wire facing unit 40. A connector strut 60 configured in accordance with the present invention is then attached in a manner to be described. In the event that the apertures 56 do not align precisely with the protuberances 55, the cross-bar 54*a* of the geogrid can be cut or slit to separate the apertures to fit over the protuberances.

If desired, an erosion blanket 30 of conventional construction, such as a geotextile, may be placed inside the wire facing unit 40, and aggregate 80, such as soil or the like, is then filled behind the rear face of the face section 42, on top of the upper face of the floor section 44 of the wire facing unit 40, and over the geogrid section 50.

A further tier or layer of geogrid-reinforced retaining wall, such as 20' shown in FIG. 1, can then be constructed on top of the initial tier 20 with the front of the face section 42' of superior wire facing unit 40' positioned rearwardly from the front of the face section 42 of the wire facing unit 40 to form a stepped-back retaining wall as seen in FIG. 1.

Obviously, if desired, the superior sections can be positioned directly above the inferior sections to form a retaining wall with a continuous, generally vertical, face (not shown), rather than a stepped-back face (as shown), but the stepped-back arrangement enhances the stability of the face of the retaining wall and enables the incorporation of plantings such as illustrated at 90 in front of upper face sections for erosion control and improved aesthetics.

Figure 3A:
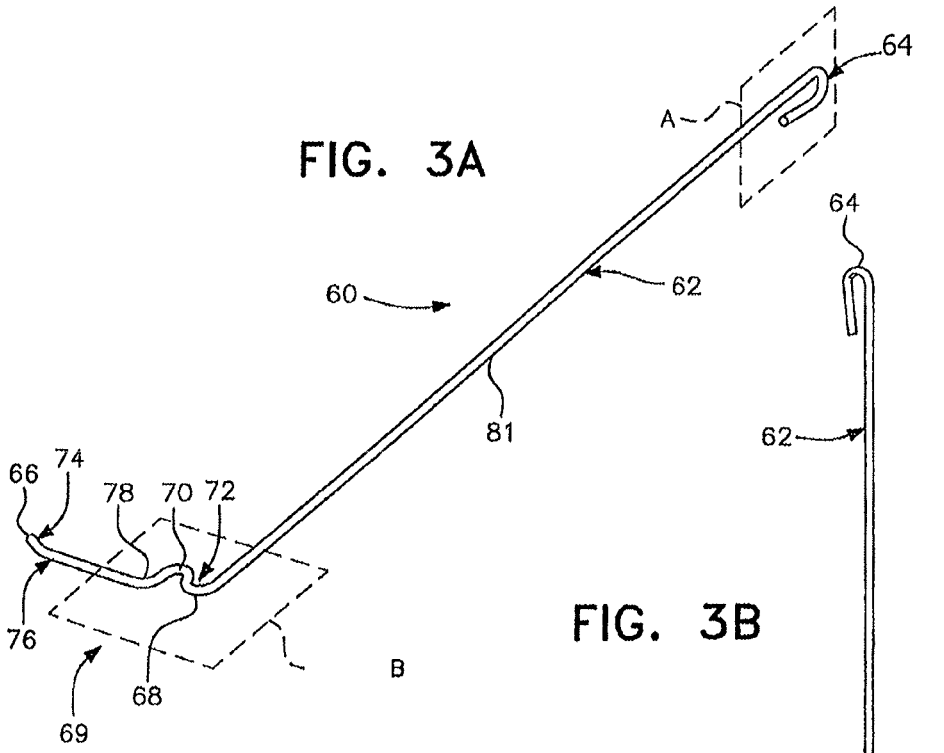
FIGS. 3A and 3B depict perspective views of a connector strut in accordance with the present invention.
Figure 3B:
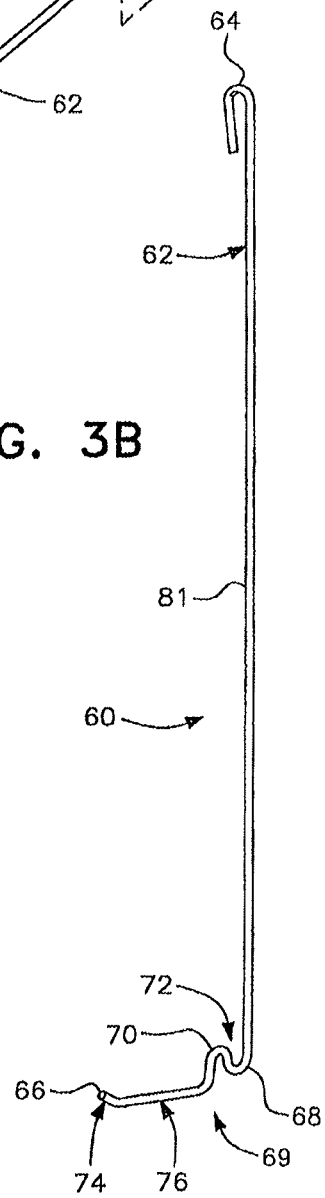

The connector strut 60 of the present invention is depicted in FIGS. 3A and 3B. The connector strut 60 is formed from a rigid rod 62, preferably of metal, such as steel or the like, that extends from a free first end 64 to a free second end 66. The rod 62 is depicted as circular in cross-section, but other rod shapes, such as oval, hexagonal, triangular, rectangular, etc., can be utilized, all of which are "rod(s)" within the scope of the present invention. The free first end 64 of the elongated rigid rod 62 is curved so as to hook the connector strut 60 to the face section 42 transverse cross-wire element 48*b* in a manner to be described. The elongated rod 62 of the connector strut 60 extends longitudinally to a substantially right-angled bend 68 to form a connector rod, or link, portion, generally designated by reference numeral 69. The connector rod portion 69 then extends from the bend 68 to the free second end 66. A substantially U-shaped ridge 70 is preferably formed adjacent the bend 68 to form a trough region 72 between the ridge 70 and the bend 68. The rod includes a preferably straight section 76 extending from the ridge 70 toward the free second end 66. Preferably, the free second end 66 includes an oblique angled portion 74.

As shown in FIG. 3A, the longitudinally extending rod 62 and the curved first end portion 64 lie in a first plane, plane A. The connector rod portion 69 between the bend 68 and the free second end 66 lie in a second plane, plane B. Planes A and B are orthogonal, i.e., perpendicular to each other. Of course, "orthogonal" can permit slight deviations from exact perpendicularity.

Figure 5A:
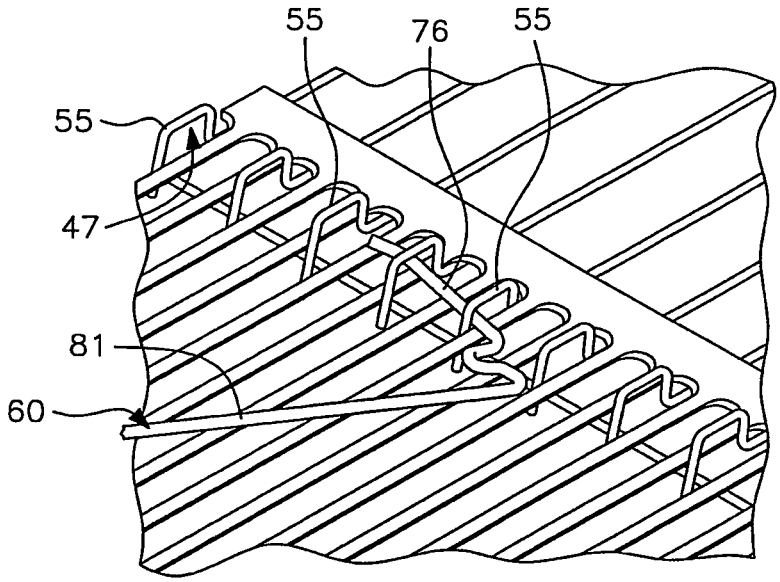
FIGS. 5A, 5B and 5C depict the method of interconnecting or threading the connector strut through the aligned openings of the protuberances to secure the geogrid to the floor section in accordance with the present invention.
Figure 5B:
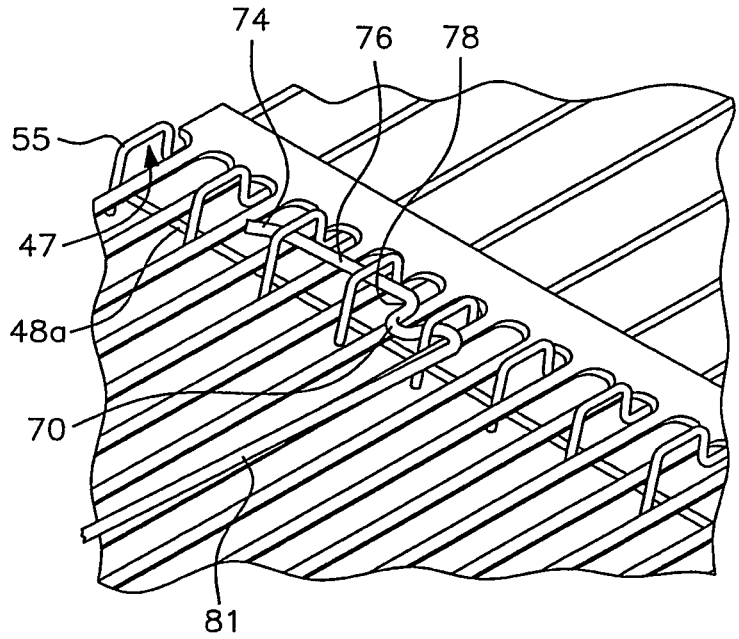
Figure 6A:
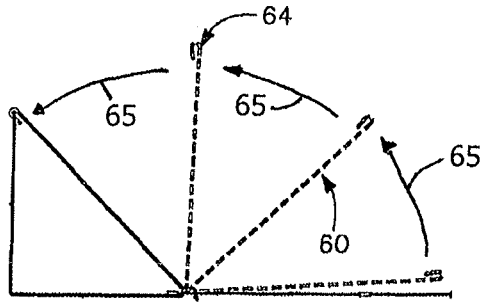
FIGS. 6A, 6B, 6C and 6D depict the rotation of the connector strut from the geogrid to the face section of the facing unit.
Figure 6B:
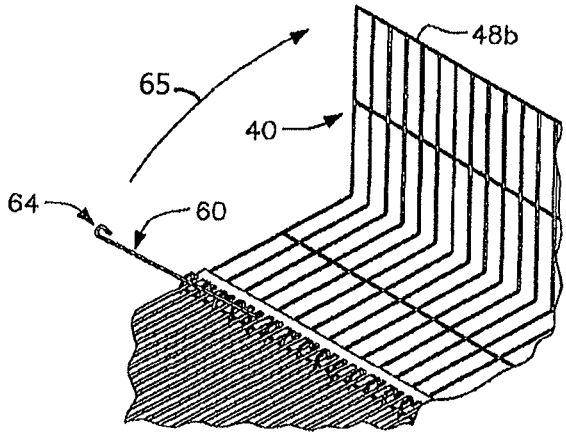
Figure 6C:
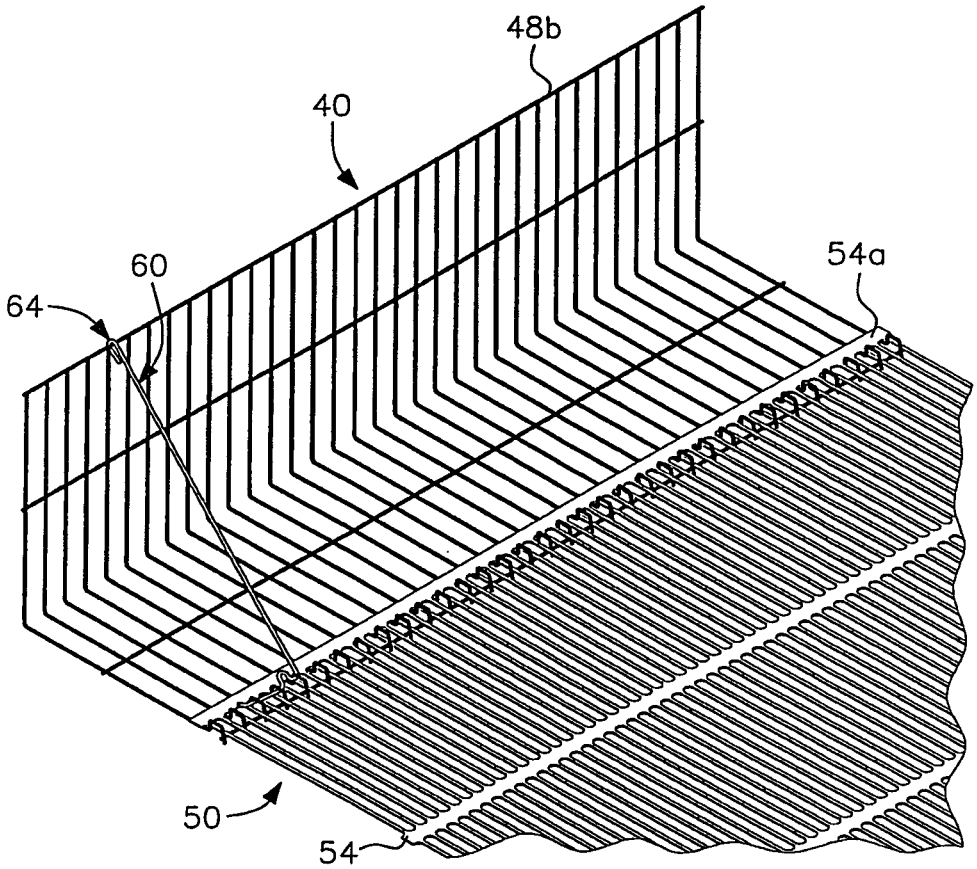
Figure 6D:
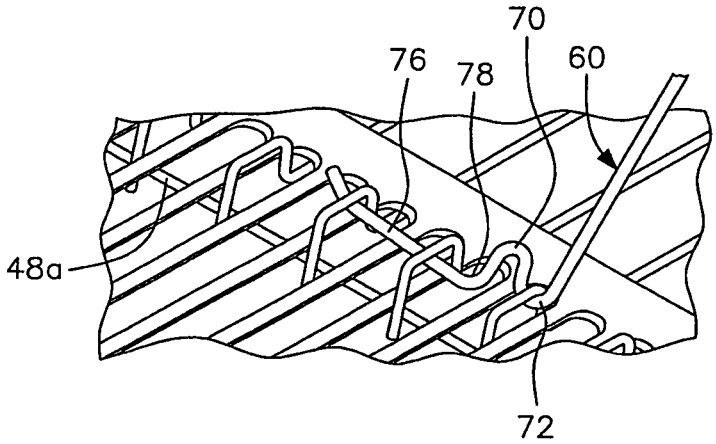

The distance between the free first end 64 of the connector strut rod 62 to the bend 68 is substantially equal to the distance between the transverse cross-wire element 48*b* at the top edge 43 of the face section 42 and the protuberances 55 on the floor section 44. See, for example, the fully assembled structure of FIG. 7. The length of the rod section 76 from the ridge end 78 to where the oblique angled portion 74 starts its angular rise is preferably less than the distance between three adjacent protuberances and greater than the distance between two adjacent protuberances as is best shown in FIGS. 5B and 6D. This rod section 76 is preferably a straight section. The width of the U-shaped ridge 70 must be less than the distance between adjacent protuberances so that the ridge can fit within the adjacent protuberances when in a locked position. See FIG. 6D.

Figure 4B:
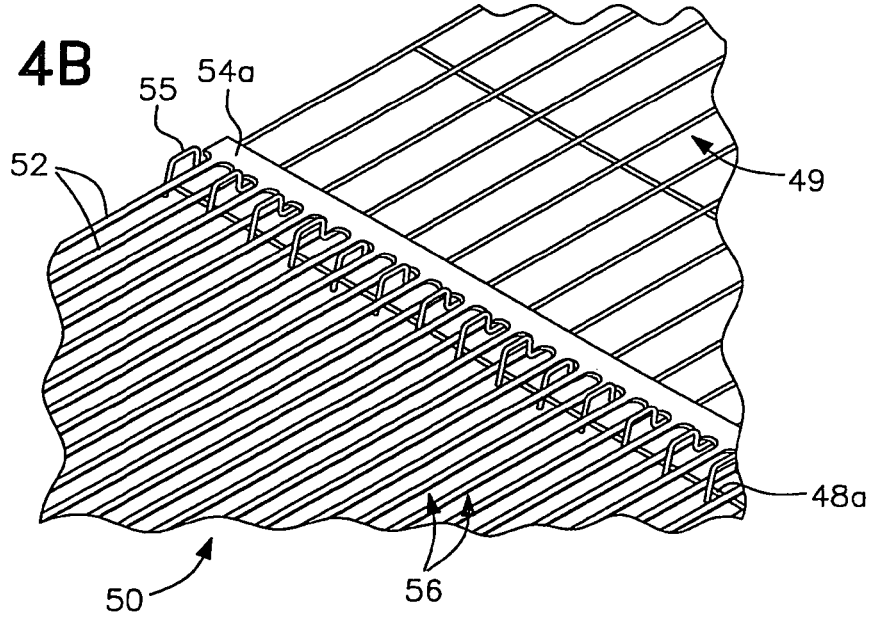

The interconnection between the geogrid 50, the wire facing unit 40, and the connector strut 60, and the method for interconnecting the three items is depicted in FIGS. 4, 5 and 6. With reference to FIG. 4A, the wire facing unit 40, after placement on site with the floor section 44 lying substantially flat, has a polymer geogrid 50 placed in partial overlying relation to the floor section 44 and extending rearwardly. The polymer geogrid 50, preferably a uniaxial geogrid, is placed over the protuberances 55 of the floor section and extends rearwardly therefrom, i.e., in a distance away from the face section 42. The manner of placing the uniaxial geogrid over and on top of the floor section protuberances is also disclosed in the '726 patent, incorporated by reference herein.

Figure 5C:
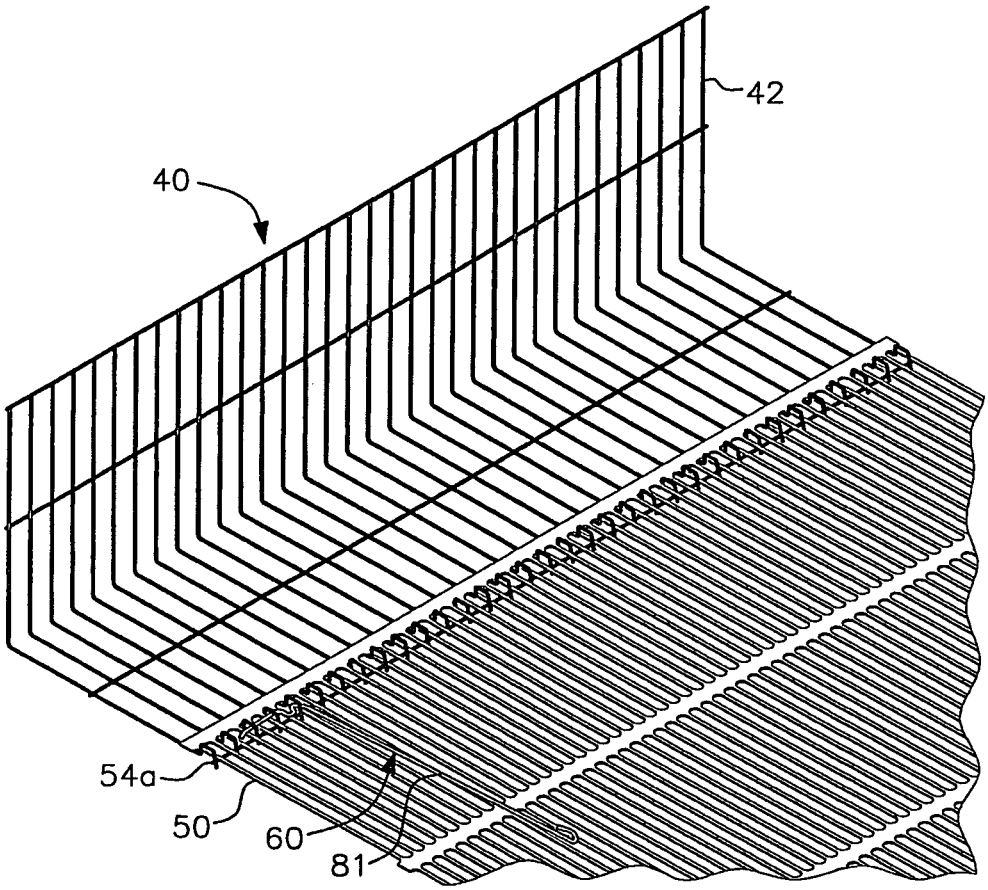

After positioning of the uniaxial geogrid apertures over the corresponding protuberances 55 of the floor section (keeping in mind that a one-to-one correspondence is not required—as shown in FIG. 5B, the protuberances 55 extend through every other aperture of the geogrid), the connector rod portion 69 of the connector strut 60 is inserted to secure the geogrid to the floor section. As shown in FIGS. 5A-5C, the connector rod portion 69 of the strut 60 is inserted through aligned openings 47 of the floor section protuberances 55 until the U-shaped ridge 70 of the connector strut 60 is located between adjacent protuberances with the elongated rod portion 81 that extends between the curved first end 64 and the bend 68 substantially perpendicular to the cross-wire element 48*a* of the floor section 44. That is, the free section end 66 of the connector rod portion 69 extends through the aligned openings 47, and the elongated support rod portion 81 is then positioned so as to be substantially perpendicular to the transverse cross-wire element 48*a* at the rear edge as is shown in FIG. 5B. After placement, the elongated connector strut 60 lies over the geogrid, as depicted in FIG. 5C, and the next connector strut in this series is installed in a similar manner (not shown). A plurality of connector struts is provided, the number of which depends upon the width of the facing unit and the strength required to be maintained between the face section 42 and the floor section 44. For example, as shown in FIG. 7, four connector struts 60 are shown spaced apart from each other approximately one-quarter to one-third the overall width w of the facing unit 40.

After all of the connector rod portions 69 of the connector struts 60 are threaded through the aligned openings 47 of the floor section protuberances 55 and the connector struts lie upon the geogrid 50, the connector struts 60 are then rotated upward by the installer so as to hook the curved first end 64 to the transverse cross-wire element 48*b* at the top edge 43 of the face section 42. The rotation is shown schematically in FIGS. 6A and 6B by arrows 65 and the locked connector strut 60 is shown in FIGS. 6C and 6D. When in the locked position, the upstanding U-shaped ridge 70 of the connector rod portion 69 is captured between adjacent protuberances 55 and the trough region 72 between the elongated rod bend 68 and ridge 70 captures one of the adjacent protuberances as best shown in FIG. 6D. The fully formed arrangement is shown in FIG. 7. This forms the retaining wall system and the body of fill material 80, 80', such as aggregate, soil or the like, is filled in for each aligned row of facing units with the upper tier then assembled thereover.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. A wire facing unit and strut assembly for a geogrid-reinforced retaining wall comprising, (a) at least one wire facing unit including a face section having a top edge and a bottom edge, said face section formed from plural parallel wire elements extending from said top edge to said bottom edge interconnected by at least one transverse cross-wire element, and a floor section extending angularly from said face section at said face section bottom edge, said floor section having a rear edge, said floor section formed from plural parallel wire elements extending from said bottom edge to said rear edge and forming protuberances defining aligned openings adjacent said rear edge, said parallel wire elements of said floor section interconnected by at least one transverse cross-wire element at said rear edge, and (b) a plurality of unitary rigid connector struts interconnecting said face section and said floor section for providing support therebetween, each said connector strut formed from a rigid rod having a curved first end to hook said connector strut to said at least one face section transverse cross-wire element and a substantially right-angled bend forming a connector rod portion at the other end of said rigid rod, said connector rod portion inserted and retained within a plurality of said floor section aligned openings when said first end is hooked to said at least one face section transverse cross-wire element, said connector rod portion including a substantially U-shaped ridge adjacent said bend, and a rod section extending from said ridge insertable within said aligned openings.

2. The wire facing unit and strut assembly according to claim 1, wherein said connector rod portion includes a trough region between said U-shaped ridge and said bend to engage and capture one of said adjacent floor section protuberances.

3. The wire facing unit and strut assembly according to claim 2, wherein said connector rod portion includes an oblique angled portion adjacent the other end of said rod.

4. The wire facing unit and strut assembly according to claim 1, wherein said curved first end and longitudinally extending rod lie in a first plane and said connector rod portion between said bend and said other end lie in a second plane that is orthogonal to said first plane.

5. The wire facing unit and strut assembly according to claim 1, wherein said connector struts are formed of metal.

6. The wire facing unit and strut assembly according to claim 1, wherein the length of each connector strut between the curved first end and the substantially right-angled bend of said rigid rod is approximately equal to the distance between said at least one transverse cross-wire element of said face section and said protuberances on said floor section.

7. The wire facing unit and strut assembly according to claim 3, wherein said rod portion extends from said ridge to said oblique angled portion adjacent said other end of the rod and has a length greater than the distance between two adjacent protuberances and less than the distance between three adjacent protuberances.

8. A retaining wall system for a geogrid-reinforced retaining wall comprising, in combination, an assembly of elements including, (a) at least one wire facing unit including a face section and a floor section extending angularly from said face section, said face section and said floor section formed from plural continuous parallel extending wire elements bent angularly near the midpoints of said wire elements, said face section having a transverse cross-wire element transverse, to said parallel extending wire elements and said floor section having at least one transverse cross-wire element at a rear edge of said floor section, the wire elements of said floor section forming protuberances defining aligned openings adjacent said rear edge, and (b) at least one geogrid positioned to overlie a portion of said floor section and having a plurality of apertures, said floor section protuberances extending through said apertures; and (c) a plurality of connector struts interconnecting said face section and said floor section for providing support therebetween and for securing said geogrid to said floor section, each said connector strut formed from a rigid rod having a curved first end to hook said connector strut to said face section transverse cross-wire element, said rigid rod extending longitudinally to a substantially right-angled bend, said rigid rod forming a substantially U-shaped ridge adjacent said bend, and defining a connector rod portion extending from said bend to a second end of the elongated rod, said connector rod portion insertable within a plurality of said floor section aligned openings to overlie and secure said geogrid to said floor section with said U-shaped ridge captured between adjacent floor section protuberances.

9. The retaining wall system for a geogrid-reinforced retaining wall according to claim 8, wherein said connector rod portion includes a trough region between said U-shaped ridge and said bend to engage and capture one of said adjacent floor section protuberances.

10. The retaining wall system for a geogrid-reinforced retaining wall according to claim 8, wherein said connector rod portion includes an oblique angled portion at the second end of said rod and a substantially straight rod section between said U-shaped ridge and said oblique angled portion.

11. The retaining wall system for a geogrid-reinforced retaining wall according to claim 8, wherein said curved first end and longitudinally extending rod lie in a first plane and said connecting rod portion between said bend and said second end lie in a second plane that is orthogonal to said first plane.

12. The retaining wall system for a geogrid-reinforced retaining wall according to claim 8, wherein said elongated rod is formed of metal.

13. The retaining wall system for a geogrid-reinforced retaining wall according to claim 8, wherein the length of said rod between said curved first end and said substantially right-angled bend is approximately equal to the distance between said transverse cross-wire element at said top edge of said face section and said protuberances on said floor section.

14. The retaining wall system for a geogrid-reinforced retaining wall according to claim 10, wherein said substantially straight rod section extending from said ridge to said oblique angled portion is greater than the distance between two adjacent protuberances and less than the distance between three adjacent protuberances.

15. A method for securing a geogrid to a wire facing unit of a retaining wall, said wire facing unit including a face section having a top edge and a bottom edge with a transverse cross-wire element adjacent said top edge, and a floor section extending angularly from said face section at said face section bottom edge, said floor section having a rear edge with at least one transverse cross-wire element at said rear edge, said floor section formed from plural parallel wire elements extending from said bottom edge to said rear edge and forming protuberances defining aligned openings adjacent said rear edge, said geogrid including a plurality of apertures arranged in parallel rows and overlying at least a portion of the floor section with one or more of the apertures within a row receiving the floor section protuberances, the geogrid extending in a rearward direction from the face section, said method of securing comprising the steps of, (a) providing a plurality of connector struts, each connector strut formed from a rod having a curved first end, a substantially right-angled bend with a substantially U-shaped ridge adjacent said bend, a trough region between said U-shaped ridge and said bend, and a rod section extending from said ridge toward a second end of the rod;

(b) inserting the rod section of the connector strut through one or more aligned openings of the floor section on top of the geogrid so that (1) the U-shaped ridge at the connector strut is located between adjacent protuberances, and (2) the elongated rod portion of the connector strut that extends between the curved first end and the bend is substantially perpendicular to said at least one transverse cross-wire element at said rear edge of the floor section, and (3) the trough region captures one of said adjacent protuberances; and (c) rotating the elongated rod in a direction toward the face section until the curved first end of the connector strut hooks about the transverse cross-wire element adjacent the top edge of the face section.

16. The method of claim 15 further comprising the step of positioning each connector strut to overlie the rearwardly extending geogrid with the curved first end of the connector strut furthest away from the protuberances before the rotating step (c).

17. A wire facing unit and strut assembly for a geogrid-reinforced retaining wall comprising, (a) at least one wire facing unit including a face section having a top edge and a bottom edge, said face section formed from plural parallel wire elements extending from said top edge to said bottom edge interconnected by at least one transverse cross-wire element, and a floor section extending angularly from said face section at said face section bottom edge, said floor section having a rear edge, said floor section formed from plural parallel wire elements extending from said bottom edge to said rear edge and forming protuberances for engaging a geogrid, said protuberances defining aligned openings adjacent said rear edge, said parallel wire elements of said floor section interconnected by at least one transverse cross-wire element, and (b) a plurality of unitary rigid connector struts interconnecting said face section and said floor section for providing support therebetween and for retaining a geogrid to said floor section, each said connector strut formed having a curved first end to hook said connector strut to said at least one face section transverse cross-wire element and a second end including support means for supporting said face section with respect to said floor section, said second end also including geogrid retaining means for retaining a geogrid to said protuberances of said floor section.

18. The wire facing unit and strut assembly according to claim 17, wherein said geogrid retaining means includes a rod integral with each of said connector struts insertable within said protuberances of said floor section to overlie a geogrid that receives said protuberances.

* * * * *